US005699667A

United States Patent [19]

Joos

[11] Patent Number: 5,699,667

[45] Date of Patent: Dec. 23, 1997

[54] GAS-OPERATED PREMIXING BURNER FOR GAS TURBINE

[75] Inventor: Franz Joos, Weilheim, Germany

[73] Assignee: Asea Brown Boveri AG, Baden, Switzerland

[21] Appl. No.: 572,567

[22] Filed: Dec. 14, 1995

[30] Foreign Application Priority Data

Dec. 28, 1994 [DE] Germany ..... 44 46 945.4

[51] Int. Cl.[6] ..... F23R 3/30

[52] U.S. Cl. ..... 60/737; 60/739; 60/746

[58] Field of Search ..... 60/737, 738, 739, 60/746; 431/351, 352

[56] References Cited

U.S. PATENT DOCUMENTS

| | | | |
|---|---|---|---|
| 4,603,548 | 8/1986 | Ishibashi et al. | 60/746 |
| 4,735,052 | 4/1988 | Maeda et al. | 60/746 |

FOREIGN PATENT DOCUMENTS

| | | |
|---|---|---|
| 0321809B1 | 6/1989 | European Pat. Off. . |
| 0522832A1 | 1/1993 | European Pat. Off. . |
| 0592717A1 | 4/1994 | European Pat. Off. . |
| 2696211 | 4/1994 | France . |
| WO93/17279 | 9/1993 | WIPO . |

*Primary Examiner*—Louis J. Casaregola

*Attorney, Agent, or Firm*—Burns, Doane, Swecker & Mathis

[57] ABSTRACT

In a gas-operated, flame-stabilizing premixing burner for a combustion chamber, the combustion air can be introduced at least approximately tangentially into a premixing space (130). The fuel is injected via a plurality of nozzles (117) lined up in the longitudinal direction of the premixing space and is intensively mixed with the combustion air prior to ignition. The nozzles (117) are subdivided into at least two groups having a separate fuel feed (120, 121) in each case.

4 Claims, 2 Drawing Sheets

GAS-OPERATED PREMIXING BURNER FOR GAS TURBINE

BACKGROUND OF THE INVENTION

1. Field of the Invention

The invention relates to a gas-operated, flame-stabilizing premixing burner for the combustion chamber, for example, of a gas turbine, in which premixing burner the combustion air can be introduced at least approximately tangentially into a premixing space and in which the fuel is injected via a plurality of nozzles lined up in the longitudinal direction of the premixing space and is intensively mixed with the combustion air prior to ignition.

2. Discussion of Background

Premixing burners in which flame retention baffles can be dispensed with are known in the form of the double-cone burner according to U.S. Pat. No. 4,932,861 to Keller et al. In these burners inside a conical zone between the injected fuel and the combustion air a premixing or pre-evaporation process takes place at a high excess-air coefficient before the actual combustion process downstream of the burner takes place. The emission values of pollutants from the combustion can be considerably reduced by this measure.

Combustion having the highest possible excess-air coefficient, because the flame is actually still burning and because not too much CO develops, not only reduces the $NO_x$ pollutant quantity but in addition also keeps other pollutants at a low level, namely CO, as already mentioned, and unburnt hydrocarbons. This enables a higher excess-air coefficient to be selected, in which case larger quantities of CO certainly develop to begin with but these quantities of CO can react further to form $CO_2$ so that finally the CO emissions remain low. On the other hand, however, only a little additional NO forms on account of the large amount of excess air.

Since a plurality of cone burners in a combustion chamber perform the premixing function, in each case only so many elements are operated with fuel during the load control that the optimum excess-air coefficient is obtained for the respective operating phase (start, part load, full load).

However, all combustion chambers having premixing burners are inadequate in the sense that the limit of flame stability is nearly reached at least in the operating states in which only some of the burners are operated with fuel or during which a reduced fuel quantity is admitted to the individual burners. Indeed, under typical gas-turbine conditions, the extinction limit will already reached at an excess-air coefficient of about 2.0 on account of the very lean mixture and the resulting low flame temperature.

This fact leads to a relatively complicated mode of operation of the combustion chamber with correspondingly complicated control. Assisting the burner by means of a small diffusion flame is seen as another possibility of extending the operating range of premixing burners. This pilot flame receives pure fuel or at least poorly premixed fuel, which on the one hand certainly leads to a stable flame but on the other hand results in the high $NO_x$ emissions typical of diffusion combustion.

SUMMARY OF THE INVENTION

Accordingly, one object of the invention, in attempting to avoid all these disadvantages, is to provide a measure by means of which the combustion chamber, even in the part-load range, can be operated as close to the lean extinction limit as possible, i.e. in that region in which virtually no $NO_x$ develops.

According to the invention, this is achieved in a premixing burner of the type mentioned at the beginning when the nozzles are subdivided into at least two groups having a separate fuel feed in each case.

It is certainly already known from U.S. Pat. No. 5,482,457 to Aigner et al. to provide additional fuel nozzles in the region of the burner axis in a gas-operated double-cone burner and to feed these fuel nozzles via a separate fuel line. However, this measure serves to specifically influence the fuel profile at the discharge of the burner. In fact, the fuel concentration in the region of the burner axis is to be greater than the average fuel concentration in the discharge plane of the burner. Thus the burner is assisted in critical phases, for example when vibrations temporarily occur, during which the extinction limit for premixing combustion having a uniform fuel profile may be exceeded for a time. In this known burner, the flame produced can be kept substantially more stable by the enrichment of the fuel profile in the region of the burner axis and by the zones with different excess-air coefficient which are thus created.

The advantage of the present invention can be seen, inter alia, in the fact that the burners remain operable on a very lean mixture even during part load. The control can thereby be simplified in as much as air-coefficient ranges, which as a rule could not be covered by the previous premixing combustion on account of its lean extinction limit, can now be crossed during loading and relief of the combustion chamber without individual burners having to be partly switched out in the process.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

Figure 1A:
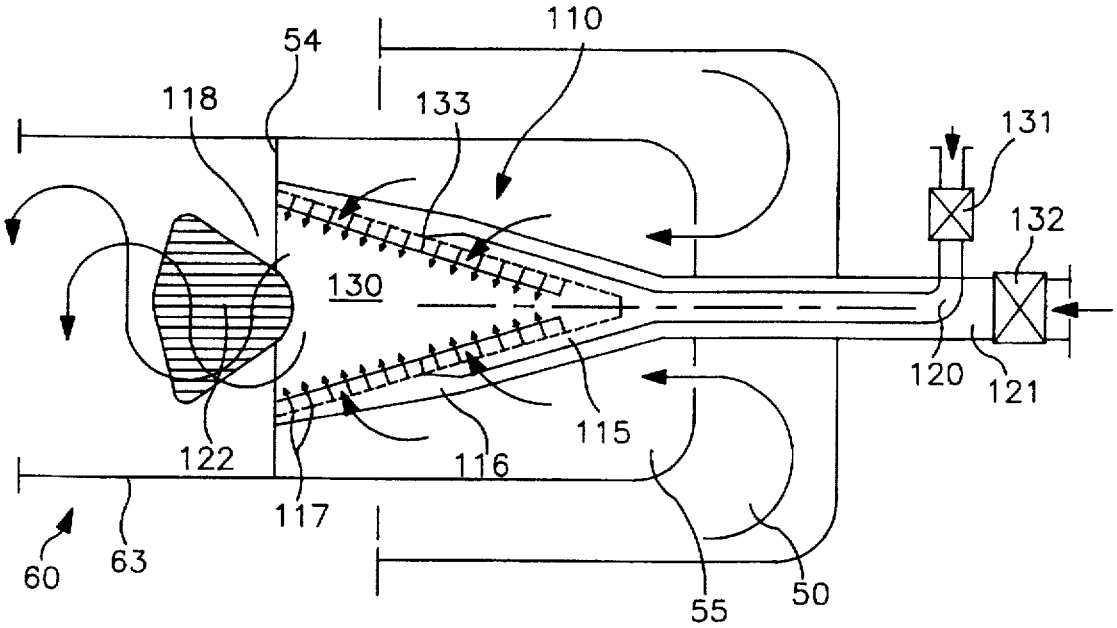
FIG. 1A shows a partial longitudinal section of a combustion chamber working in full-load operation.

Only the elements essential for understanding the invention are shown. Not shown, for example, are the complete combustion chamber and its allocation to a plant, the provision of the fuel, the control equipment and the like. The direction of flow of the working media is designated by arrows.

DESCRIPTION OF THE PREFERRED EMBODIMENTS

Referring now to the drawings, wherein like reference numerals designate identical or corresponding parts throughout the several views, in FIG. 1 an encased plenum is designated by 50, which as a rule receives the combustion air delivered by a compressor (not shown) and feeds it to an annular combustion chamber 60.

An annular dome 55 is mounted on the head end of the combustion chamber, the combustion space of which is encased by a combustion-chamber wall 63 and is defined by a front plate 54. A burner 110 is arranged in this dome in such a way that the burner discharge 118 is at least approximately flush with the front plate 54. Via the dome wall perforated at its outer end, the combustion air flows out of the plenum 50 into the dome interior and is admitted to the burner. The fuel is fed to the burner via two fuel lances 120, 121 which pass through the dome and plenum walls.

Figure 2:
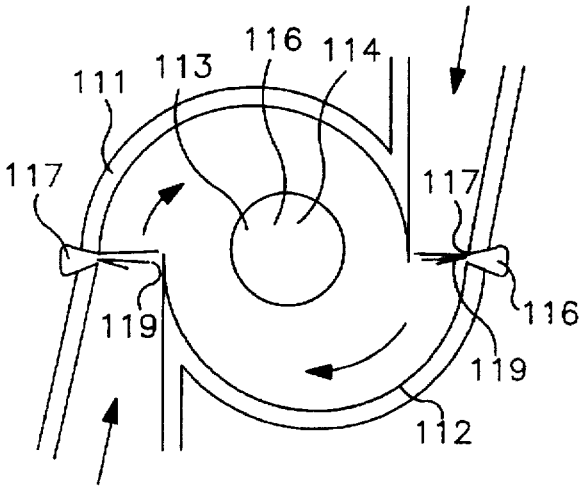
FIG. 2 shows a cross section through a premixing burner of the double-cone type of construction in the region of its discharge.
Figure 3:
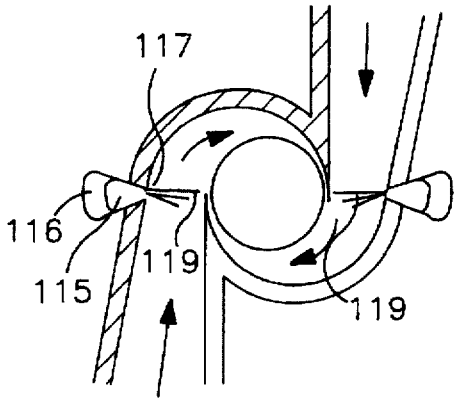
FIG. 3 shows a cross section through the same premixing burner in the region of the cone tip.

The schematically shown premixing burner 110 is a so-called double-cone burner as disclosed, for example, by U.S. Pat. No. 4,932,861 to Keller et al. mentioned at the beginning. As also apparent from FIGS. 2 and 3, it essentially comprises two hollow, conical sectional bodies 111, 112 which are nested one inside the other in the direction of flow. In this arrangement, the respective center axes 113, 114 of the two sectional bodies are mutually offset. The adjacent walls of the two sectional bodies form slots 119, tangential in their longitudinal extent, for the combustion air, which in this way passes into the premixing space 130 of the burner interior.

The burner is operated with gaseous fuel. To this end, gas-inflow openings 117 in the form of nozzles are provided which are distributed in the region of the tangential slots 119 in the walls of the two sectional bodies. The nozzles 117 are in each case arranged in a line and extend in the longitudinal direction of the premixing space over virtually its entire length.

According to the invention, the nozzles 117 are subdivided into two groups via a parting plane 133. In the example, the two groups each have the same number of nozzles. The nozzles are supplied per sectional cone from one collecting line 115, 116 each, which collecting lines run along the outer wall of the cone. The collecting lines 115, 116 are in turn fed via the coaxially arranged fuel lances 120, 121. The fuel control is effected via shutoff control valves 131, 132 which are arranged in the lances 120, 121 used for the separate fuel feed.

According to FIG. 1A, the two nozzle groups are supplied with fuel. In this case, therefore, the mixture formation with the combustion air already starts in the zone of the tangential gaps, specifically over the entire length of the premixing space.

At the burner discharge 118 of the burner 110, as homogeneous a fuel concentration as possible appears over the annular cross section to which the fuel is admitted. A defined calotte-shaped recirculation zone 122 develops at the burner discharge, at the tip of which recirculation zone 122 the ignition is effected. The flame itself is stabilized by the recirculation zone in front of the burner without requiring a mechanical flame retention baffle.

With such premixing combustion, the NOx level can easily remain below the limit values demanded. However, the stability limit is low on account of the low flame temperature. The range between ignitability and extinction is relatively narrow for the reliable operation of the combustion chamber over the full load range.

Figure 1B:
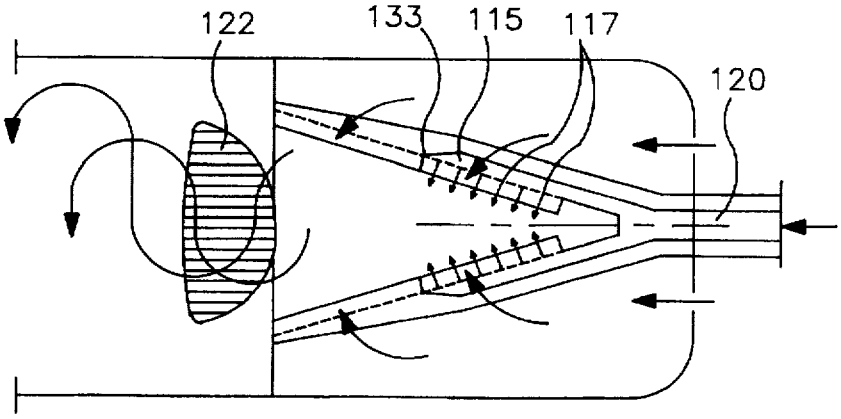
FIG. 1B shows a partial longitudinal section of the same combustion chamber working in part-load operation.

During part load, only the nozzle group arranged in the cone interior is operated with fuel, as the arrows in FIG. 1*b* indicate. As a result, a flame 122' premixed at the set air/fuel ratio forms in the burner center, which flame 122' is stabilized via the vortex breakdown. The residual air is fed via the tangential gaps in the region of the burner discharge.

In addition, the double-cone burner shown, with regard to a mixed oil/gas mode of operation, could also be equipped at the cone tip with a fuel nozzle, lying in the burner axis, for liquid fuel. The fuel can be injected from this at a certain angle into the hollow cone. The resulting conical liquid-fuel profile is enclosed by the combustion air flowing in tangentially. The concentration of the fuel is reduced continuously in the axial direction as a result of the mixing with the combustion air.

Figure 4:
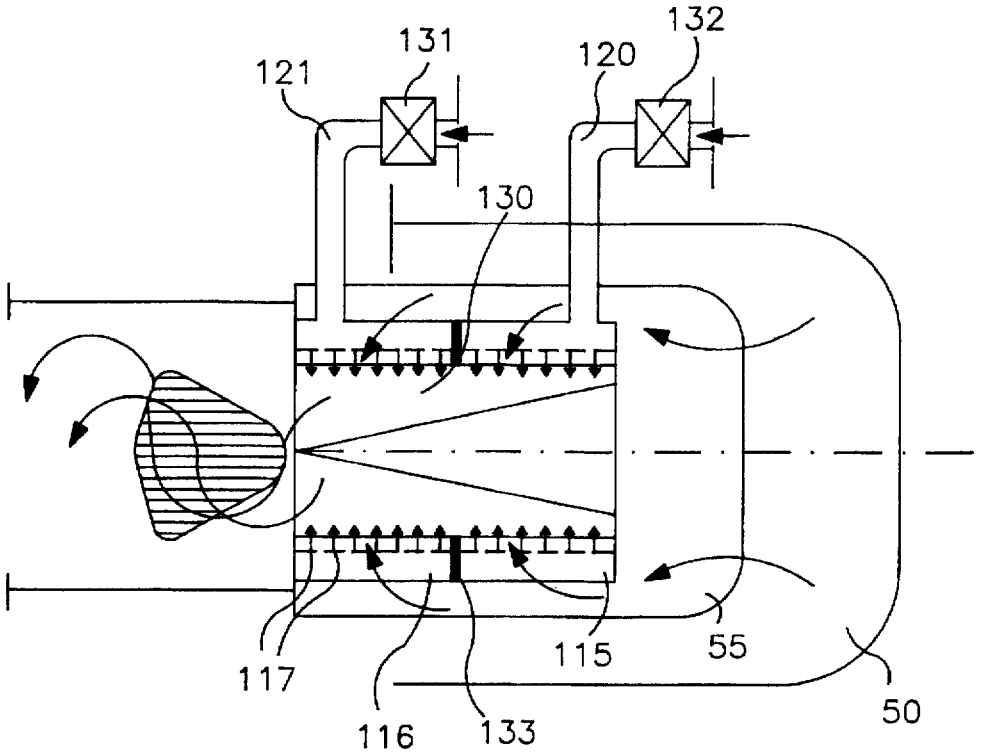
FIG. 4 shows a partial longitudinal section of a combustion-chamber variant.

In principle, the invention is also not restricted to premixing burners of the double-cone type of construction shown but may be used in all combustion-chamber zones in which flame stabilizing is produced by a prevailing air-velocity field. As a further example of this, reference is made to the burner shown in FIG. 4. In said FIG. 4, all functionally identical elements are provided with the same reference numerals as in the burner according to FIGS. 1–3. This despite a different structure, which applies in particular to the tangential inflow gaps 119 running cylindrically here.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A gas-operated, flame-stabilizing premixing burner for a combustion chamber of a gas turbine, comprising:

a burner wall having two, oppositely located, longitudinally extending openings for tangentially directed flows of combustion air into a premixing space defined by the burner wall;

a plurality of nozzles lined up in the longitudinal direction of the premixing space adjacent to the openings to inject fuel to intensively mix with the combustion air prior to ignition, wherein the nozzles are subdivided into a first group proximal an inner end of the burner space and a second group proximal an outlet end of the burner space; and first and second separate fuel feed lines to provide fuel respectively to the first and second groups, wherein the burner is operable at partial load with only the first group of nozzles, and wherein at full load the first group and second group inject fuel for a substantially uniform fuel concentration across the burner outlet.

2. The premixing burner as claimed in claim 1, further comprising a shutoff control valve in each of the first and second separate fuel feed lines.

3. The premixing burner as claimed in claim 1, wherein the at least two groups each contain approximately a like plurality of nozzles.

4. A gas-operated, flame-stabilizing premixing burner for a combustion chamber of a gas turbine, comprising:

a burner wall having two, oppositely located, longitudinally extending openings for tangentially directed flows of combustion air into a premixing space defined by the burner wall;

a first plurality of fuel nozzles proximal an inner end of the burner space and a second plurality of fuel nozzles proximal an outlet end of the burner space, the first and second pluralities of nozzles disposed in the longitudinal direction along the openings to inject fuel into the premixing space;

first and second separate fuel feed conduits to provide fuel individually to each of the first and second pluralities of fuel nozzles, wherein the first plurality of nozzles includes a sufficient number of nozzles for operating the burner during partial load with only the first plurality of nozzles.

* * * * *